US005175925A

United States Patent [19]

Grosklos et al.

[11] Patent Number: 5,175,925

[45] Date of Patent: Jan. 5, 1993

[54] MACHINING FOR ATTACHING TERMINALS TO CONDUCTORS

[75] Inventors: John R. Grosklos, York; Stephen P. Lawruk, Middletown, both of Pa.

[73] Assignee: AMP Incorporated, Harrisburg, Pa.

[21] Appl. No.: 871,940

[22] Filed: Apr. 21, 1992

[51] Int. Cl.[5] ..... H01R 43/04

[52] U.S. Cl. ..... 29/753; 72/441

[58] Field of Search ..... 29/750-754; 72/441, 446, 448

[56] References Cited

U.S. PATENT DOCUMENTS 4,970,889 11/1990 Phillips et al. ..... 72/446

5,046,241 9/1991 Ricard ..... 29/753 X

OTHER PUBLICATIONS

AMP Customer Manual CM 5445, Rev. F, Flexible Flat Cable Terminating Machine No. 682575-4 through -6.

*Primary Examiner*—Carl E. Hall

[57] ABSTRACT

A crimp height adjusting mechanism in a machine for crimping terminals onto the ends of conductors of flexible flat cables. The adjusting mechanism is interposed between the movable crimping die and its drive mechanism and effects changes in crimp height by varying its length. The adjusting mechanism utilizes a sliding wedge block that causes a followed member to extend or recede a desired amount. An adjusting screw controls the sliding movement of the wedge so that very precise changes in crimp height can be achieved.

10 Claims, 6 Drawing Sheets

MACHINING FOR ATTACHING TERMINALS TO CONDUCTORS

The present invention relates to machines for crimping terminals onto conductors and particularly to mechanisms for adjusting the crimp height of such machines to close dimensional tolerances.

BACKGROUND OF THE INVENTION

Machines for crimping terminals to the ends of conductors of flexible flat cables are typically of the type that includes a crimping die and anvil set and a movable table, to which the flexible cable is attached, which indexes the cable between the die and anvil for crimping. Such a machine is shown in FIG. 1 and identified as 10. From time to time, during operation of the machine 10, the crimp height of the crimped terminal approaches an out of tolerance condition and must be adjusted. The drive mechanism includes a stud which is threaded into a link of the mechanism to provide this adjustment. A lock nut is used to secure the stud and link in a desired position. A difficulty with this arrangement is that the effect of each attempted adjustment is not predictable to within desirable limits because the mechanism is too course. That is, given that we wish to change the crimp height by 0.001 inch, for example, it is difficult to loosen the lock nut, turn the adjusting screw the precise amount needed, and tighten the lock nut without affecting the position of the adjusting screw and achieve the desired change in crimp height.

What is needed is a fine adjusting mechanism for adjusting crimp height that is accurate, repeatable, and easy to set to a desire value.

SUMMARY OF THE INVENTION

The present invention is a fine adjusting mechanism for adjusting crimp height in a machine for attaching terminals to conductors of a flexible flat cable. The mechanism is arranged to selectively alter the operational engagement spacing between a crimping die and anvil set. The mechanism includes a plate having first and second ends and a bearing surface. A wedge block having a first surface is provided in sliding engagement with the bearing surface. The block includes a second surface opposite to and inclined to the first surface. The block is arranged to slide back and forth along the bearing surface between the first and second ends. The second surface of the block is inclined toward the bearing surface near the first end and away from the bearing surface near the second end. An adjusting screw is provided substantially parallel with the bearing surface and is in threaded engagement with the wedge block. The screw is coupled to the plate so that upon rotation of the screw in one direction the block is caused to slide along the bearing surface toward the first end of the plate and upon rotation in the other direction the block is caused to slide toward the second end. A follower member is coupled to the plate and is disposed with its longitudinal axis perpendicular to the bearing surface and is arranged for limited reciprocating motion along its axis. The follower member includes a follower surface in abutting engagement with the inclined second surface of the wedge block so that as the block undergoes its sliding movement toward the first and the follower member moves outwardly along its axis in a direction away from the bearing surface.

DESCRIPTION OF THE PREFERRED EMBODIMENT

Figure 1:
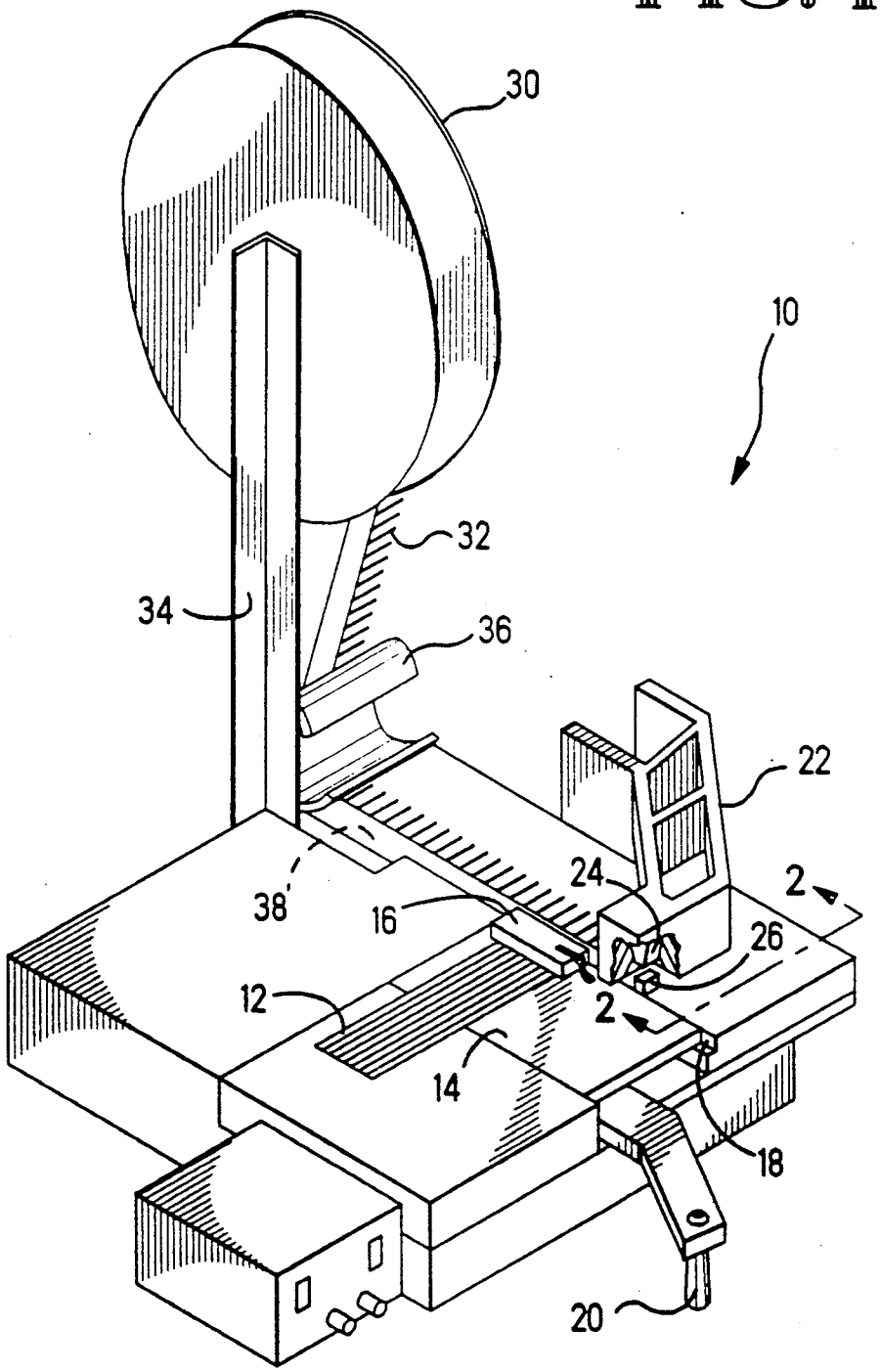
FIG. 1 is an isometric view of a machine for crimping terminals onto conductors embodying the teachings of the present invention.

There is shown in FIG. 1 a machine 10 for crimping terminals onto the ends of conductors of a flexible flat cable 12. The flexible flat cable 12 is secured to a movable table 14 by means of a suitable clamp 16. The table 14 is arranged to slide within guide ways 18, its movement being incrementally controlled by a suitable ratchet and pawl mechanism which is not shown. A handle 20 is coupled to the ratchet and pawl mechanism so that manipulation of the handle will disengage the mechanism thereby allowing the table 14 to slide freely within the ways 18. A structural member 22 rigidly attached to the frame of the machine, extends over an edge of the table 14 and includes an anvil 24 directed downwardly as shown in FIG. 1. A mating terminal crimping die 26 is positioned directly under and in alignment with the anvil. A reel 30 of terminals 32 is disposed on a reel holder 34 in the usual manner and the strip of terminals arranged around a guide 36 and along a track 38 which leads to the crimping die 26 and anvil 24. The crimping die is arranged to undergo reciprocating motion toward and away from the anvil and is driven by an electric motor, not shown, that is housed within the machine 10 and interconnected by a drive mechanism 50 that will be described below, see FIGS. 2 and 3. While a similar drive mechanism 52, shown only in FIG. 2 is arranged to move a locating jaw into and out of engagement with the terminals 32 during the crimping cycle, only the drive mechanism 50 will be described.

Figure 3:
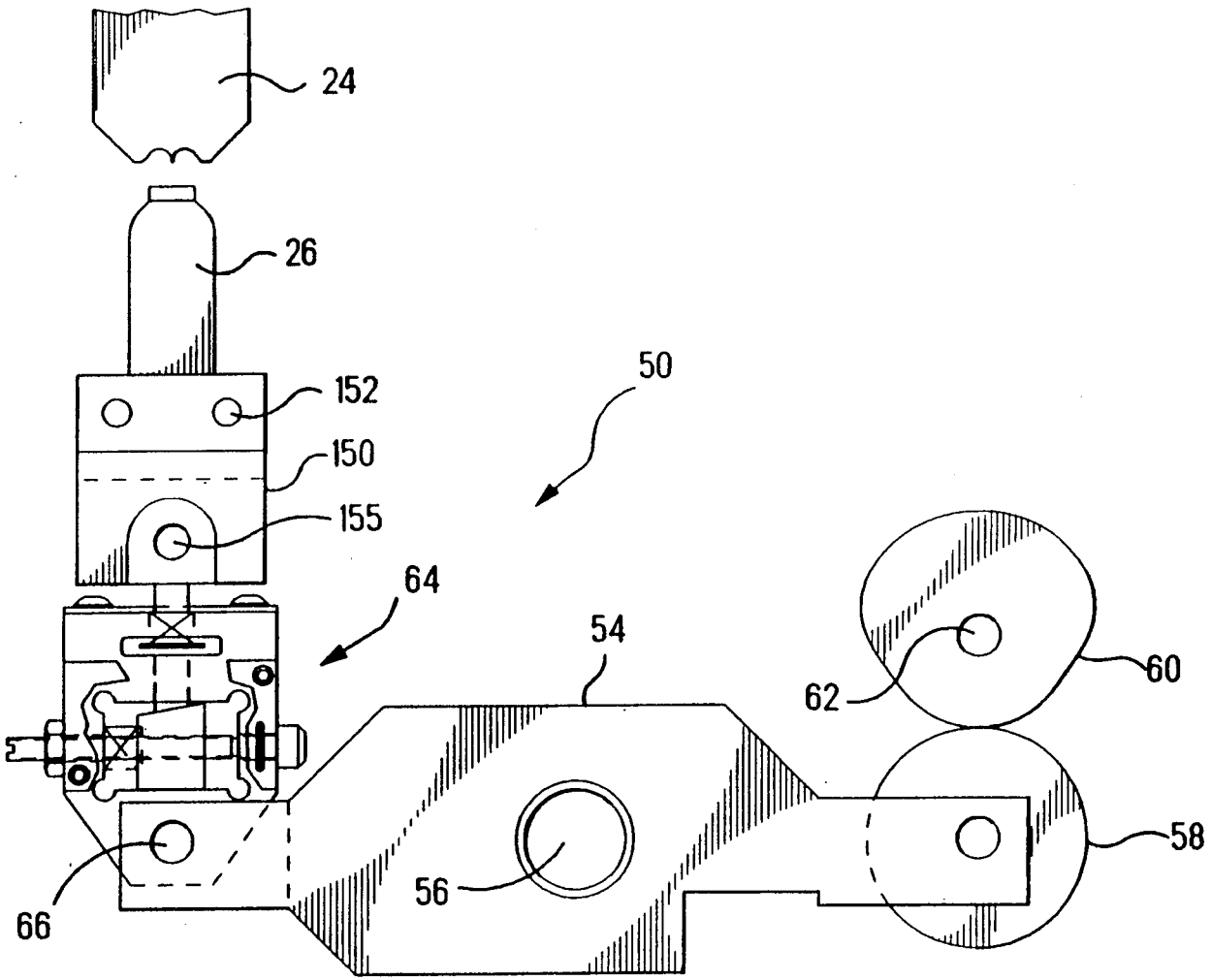
FIG. 3 is a partial cross-sectional view taken along the lines 3—3 of FIG. 2.
Figure 4:
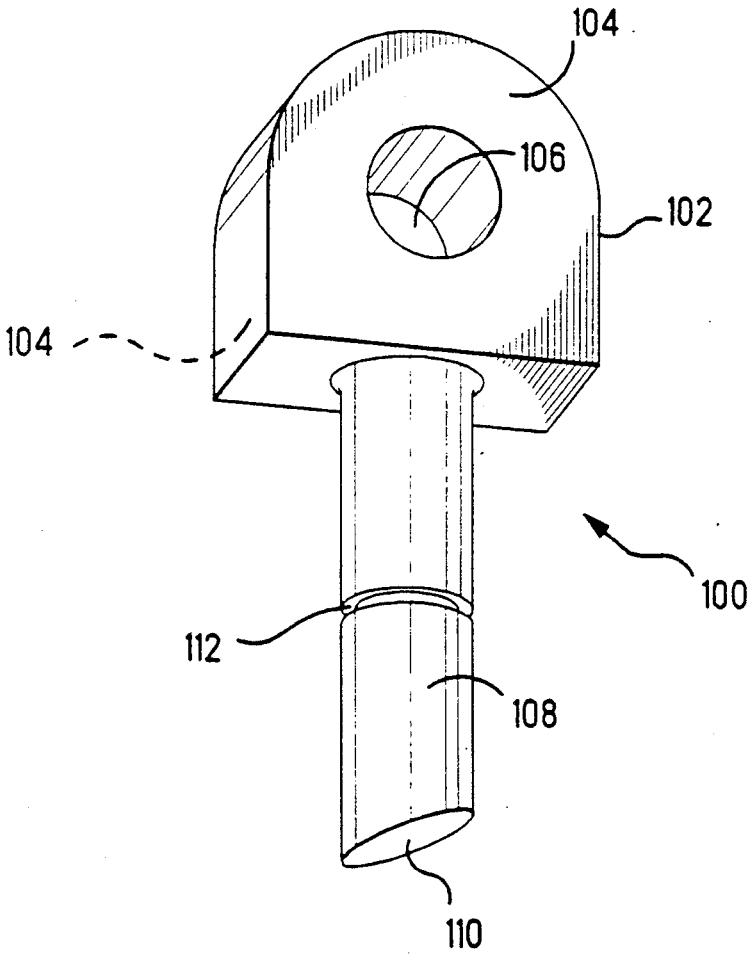
FIG. 4 is an isometric view of the follower shown in FIG. 3.
Figure 5:
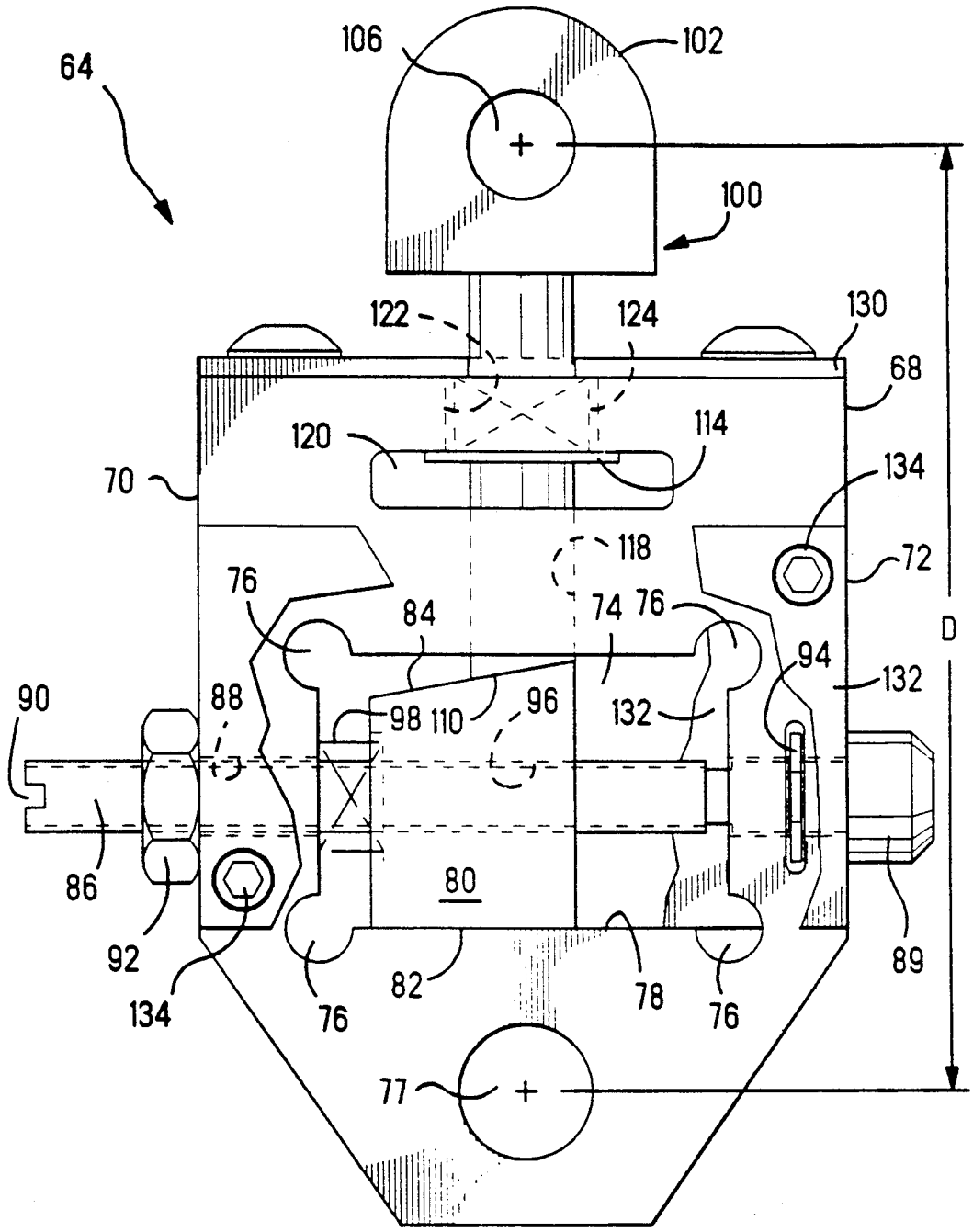
FIGS. 5 and 6 are enlarged views of a portion of the mechanism of FIG. 3 shown in different operating positions.
Figure 6:
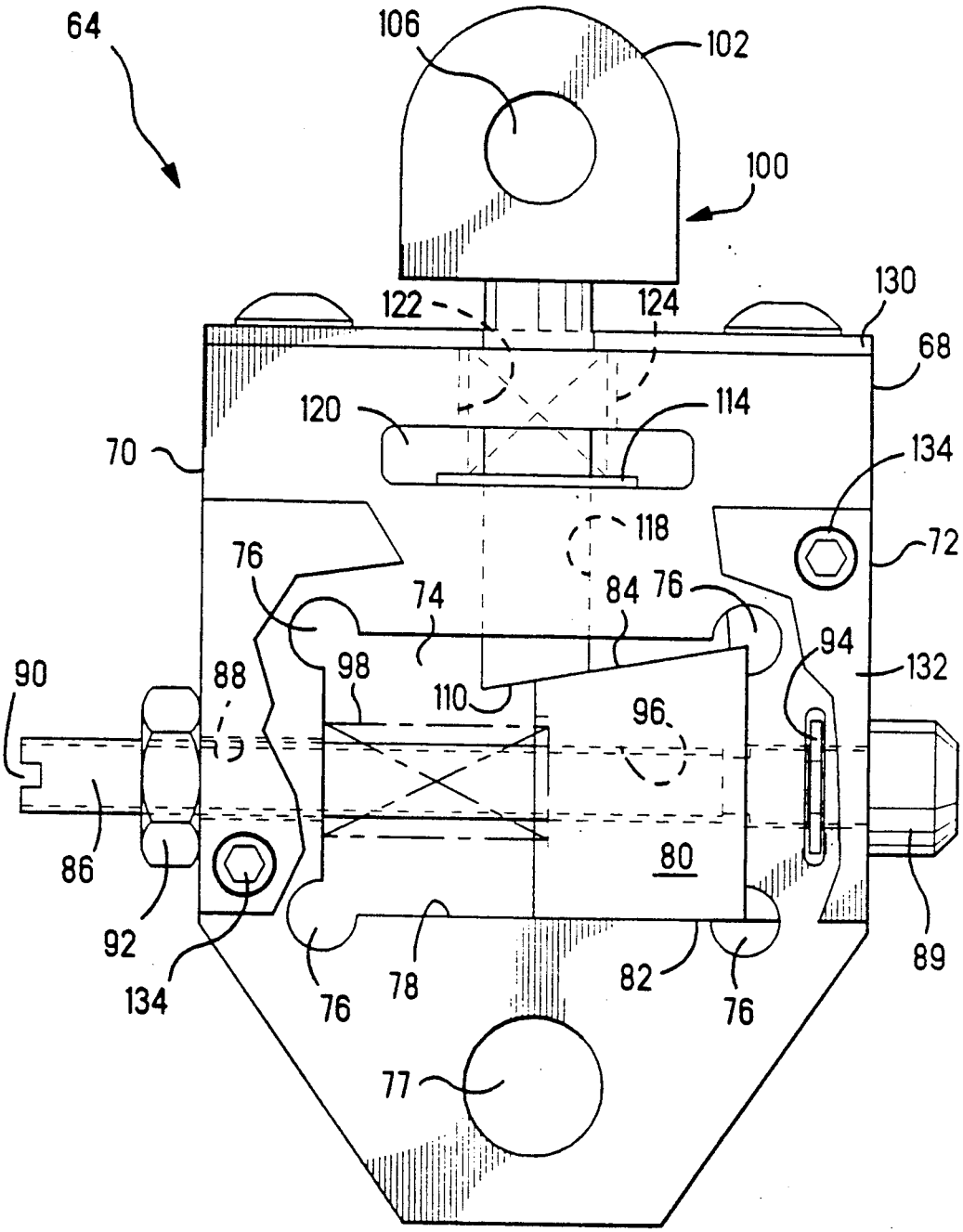

As best seen in FIG. 3, the drive mechanism 52 includes a pivoting bar 54 arranged to pivot about a shaft 56 which is fixed relative to the machine 10. A cam follower 58 is journaled for rotation in one end of the bar 54 and operationally engages a cam 60 which in turn is driven by a drive shaft 62. A crimp height adjusting mechanism 64 is pivotally coupled to the other end of the bar 54 by means of a pin 66. The crimp height adjusting mechanism includes a plate 68 having a first end 70 and a second end 72. An opening 74 is formed through the plate, which is rectangular in the present example, including clearance openings 76 at the four corners. A hole 77 is formed through the plate 68 to receive the pin 66 for coupling to the arm 54. The opening 74 forms a flat bearing surface 78 along its lower extremity. A wedge block 80 is arranged within the opening 74 and includes a lower surface 82 that is in sliding engagement with the bearing surface 78, as best seen in FIGS. 5 and 6. The wedge block 80 includes an opposite upper surface 84 that is inclined so that it slopes toward the bearing surface 78 toward the first end 70 and slopes away from the lower surface toward the second end 72. The wedge block is arranged to slide along the bearing surface 78 between the first and second ends 70 and 72 within the limits of the opening 74. An adjusting screw 86 is disposed in clearance holes 88 in the plate 68 so that the axis of the screw is directly over and parallel with the bearing surface 78, the screw spanning the opening 74. The adjusting screw 86 includes a head 89 which engages the second end 72 of the plate 68 and a slot 90 formed in the end of the screw opposite the head for a purpose that will be described below. The adjusting screw 86 is held captive to the plate 68 by means of a snap ring 94 disposed within a slot formed in the plate in the usual manner. The wedge block has a threaded hole 96 therethrough in threaded engagement with the adjusting screw 86 so that as the screw is turned in one direction the wedge block 80 is caused to slide along the bearing surface 78 toward the first end 70. As the screw 86 is turned in the opposite direction the wedge block 80 is caused to slide toward the second end 72. A compression spring 98 is arranged to urge the wedge block 80 in a direction axially along the screw 86 toward the second end 72 to remove the play in the mating parts. A follower link 100, as best seen in FIG. 4, includes a head 102 having a pair of flat parallel surfaces 104 and a through hole 106. A shank 108 of cylindrical shape projects from the head 102 substantially parallel to the surfaces 104. The free end of the shank 108 includes a follower surface 110 which is inclined with respect to a perpendicular to the outer surface of the shank. A groove 112 is disposed in the shank 108 for accommodating a snap ring 114, shown in FIGS. 5 and 6. The shank 108 is disposed in a slip fit hole 118 formed in the plate 68 substantially perpendicular to the bearing surface 78. The follower surface 110 is inclined an amount that exactly matches the incline of the upper surface 84 of the wedge block 80. A clearance slot 120 is formed through the plate 68 so that it intersects the hole 118. A clearance hole 122 is formed in the plate 68 in axial alignment with the hole 118 and includes a compression spring 124 which engages the snap ring 114 and urges the shank toward the bearing surface 78 so that the follower surface 110 remains in following engagement with the upper surface 84. A cover 130 having a hole slightly smaller than the outer diameter of the spring 124 is fastened to the plate 68 to retain the spring 124 within the hole 122 and in engagement with the snap ring 114. A pair of side plates 132, one being secured to each side of the plate 68 by means of the screw fasteners 134, are provided to reduce the chance of contamination entering the opening 74 and interfering with the operation of the mechanism. The crimp height adjusting mechanism 64, as will be described below, effects a change in crimp height by changing the distance D between the holes 77 and 106. By accurately controlling this distance the crimp height of the terminals being crimped can be maintained within tolerance. The distance D is altered by loosening the lock nut 92 and rotating the adjusting screw 86 to cause the wedge block 80 to move toward the first end 70 if the distance D is too small or to move toward the second end 72 if the distance D is too great. Note that Figure 6 shows the wedge block 80 in its right most position near the second end 72. In this position the shank 108 has extended through the hole 118 a maximum amount so that the snap ring 114 is near the lower surface of the slot 120. Similarly, FIG. 5 shows the wedge block 80 in its left most position near the first end 70.

Figure 2:
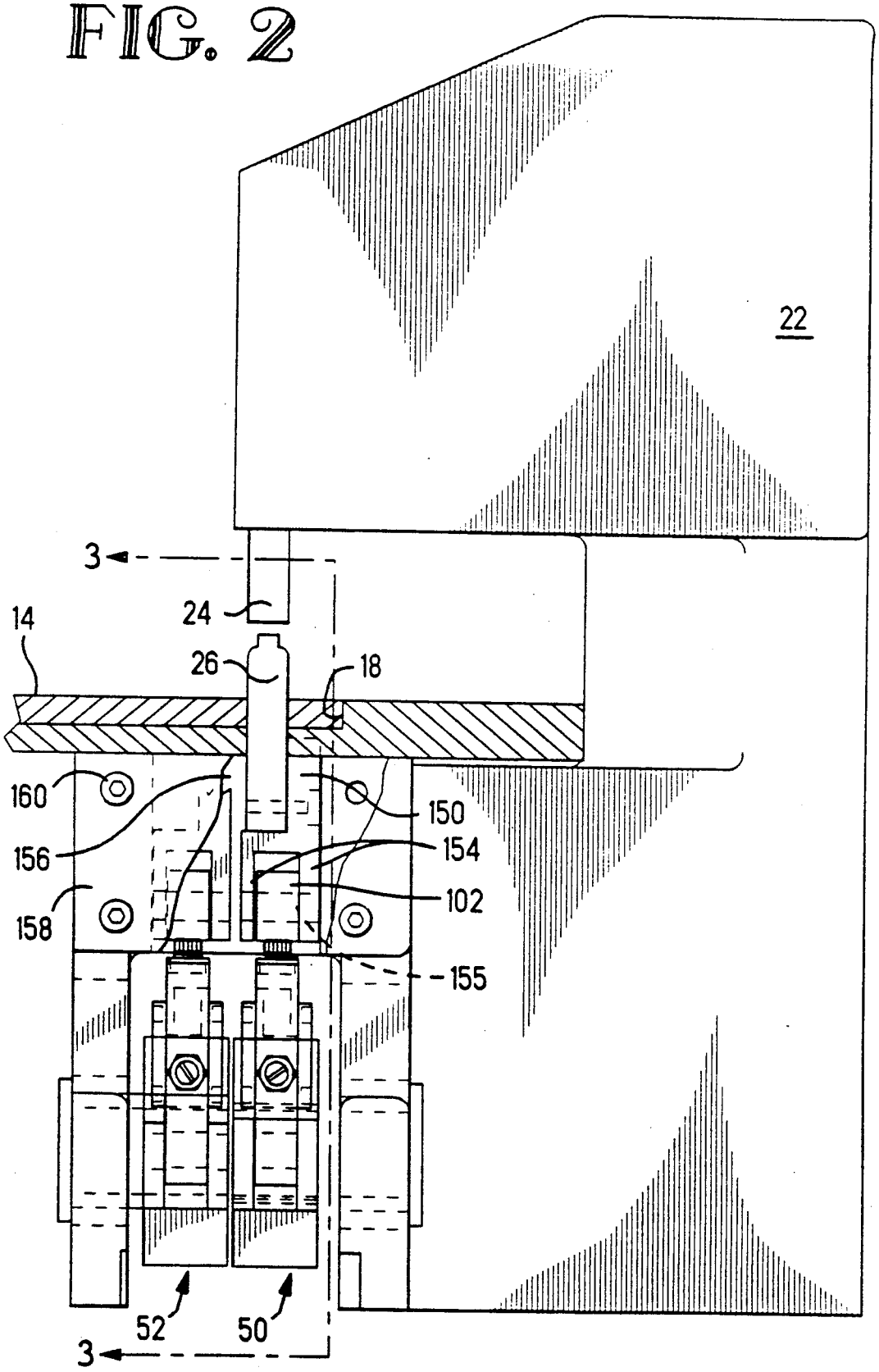
FIG. 2 is a partial cross-sectional view taken along the lines 2—2 of FIG. 1.

As best seen in FIGS. 2 and 3, the crimping die 26 is attached to a mounting block 150 by means of the screw fasteners 152. The mounting block has a pair of flanges 154 extending downwardly, as viewed in FIG. 2, which are spaced to loosely receive the head 102 of the follower link 100. The follower link 100 is pivotally coupled to the mounting block 150 by means of a pin 155 extending through the hole 106 and into the flanges 154. The mounting block 150 is arranged to reciprocate vertically within guideway 156 in the frame of the machine 10. A cover plate 158, covering the guideway, is attached by means of the screw fasteners 160.

In operation, the drive shaft 62 and rotating cam 60 cause the bar 54 to undergo a periodic pivoting motion. This pivoting motion is transferred to the mounting block 150 through the crimp height adjusting mechanism 64 by means of the pins 66 and 155, thereby causing the mounting block and attached crimping die 26 to undergo reciprocating motion toward and away from the anvil 24. During operation, when it is desired to adjust the crimp height, the machine is stopped, the lock nut 92 loosened, and the adjusting screw turned the proper amount thereby adjusting the distance D. The lock nut 92 is then tightened and production resumed. By selecting a suitable thread size for the adjusting screw and a suitable angle for the inclined upper surface 84, the sensitivity of the final adjustment of crimp height can be easily controlled. In the present example, a thread size of 8-36 UNF-2B and an angle of inclination from the horizontal of ten degrees. This permits adjustments in the distance D of the order of 0.0005 inch resulting in correspondingly accurate adjustments in the crimp height.

An important advantage of the present invention is the accuracy achieved by the adjusting mechanism and its ease of use by a relatively unskilled operator.

We claim:

1. In a machine for attaching terminals to conductors wherein said machine includes a frame, a mating crimping die and anvil set, movable means arranged for carrying said die through reciprocating motion toward and away from said anvil, said anvil being attached to said frame in alignment with said crimping die for mutual operational engagement a crimp height adjusting means coupled to said movable means for selectively altering the operational engagement spacing between said crimping die and said anvil comprising;

(a) a plate having a first end and a second end, and an opening defining a bearing surface;

(b) a wedge block having a first surface in sliding engagement with said bearing surface and a second surface opposite to and inclined to said first surface, said wedge block arranged to slide along said bearing surface in a direction toward said first end and in an opposite direction toward said second end, said second surface being inclined toward said bearing surface near said first end and inclined away from said bearing surface near said second end;

(c) an adjusting screw substantially parallel with said bearing surface in threaded engagement with said wedge block and coupled to said plate so that upon rotation of said adjusting screw in one direction said wedge block is caused to slide along said bearing surface toward said first end of said plate and upon rotation in the other direction said wedge block is caused to slide toward said second end of said plate; and (d) a follower member coupled to said plate and having a longitudinal axis disposed substantially perpendicular to said bearing surface and arranged for limited reciprocating motion along said axis, said member including a follower surface in abutting engagement with said inclined second surface of said wedge block so that as said wedge block undergoes said sliding movement toward said first end said follower member moves outwardly along its said axis in a direction away from said bearing surface.

2. The machine according to claim 1 wherein said plate includes an opening having a substantially flat surface which is said bearing surface.

3. The machine according to claim 2 wherein said wedge block is arranged within said opening.

4. The machine according to claim 3 wherein said adjusting screw extends through said opening and through said wedge block.

5. The machine according to claim 1 wherein said adjusting screw is coupled to said plate by a retaining means for holding said adjusting screw captive to said plate while permitting free rotation of said screw relative thereof.

6. The machine according to claim 1, including a drive means for driving said movable means and wherein said movable means is a mounting block arranged for said reciprocating motion within said frame, said die being attached to one end of said mounting block and said crimp height adjusting means being interposed between said mounting block and said drive means.

7. The machine according to claim 6 wherein said altering of said operational engagement spacing is effected by manipulating said adjusting screw of said crimp height adjusting means to change the distance between said mounting block and said drive means.

8. The machine according to claim 7 wherein one end of said crimp height adjusting means is pivotally attached to said mounting block and the other end of said crimp height adjusting means is pivotally attached to said drive means.

9. The machine according to claim 6 wherein said drive means includes a bar having a first end and a second end arranged to undergo periodic pivoting motion about a pivot point disposed between said first and second ends, said first end of said bar being coupled to said crimp height adjusting means and said second end being in operational engagement with a cam, said cam being rotatable by a drive shaft.

10. The machine according to claim 1 including a first resilient means for urging said wedge block in said opposite direction toward said second end, and a second resilient means for urging said follower member into said abutting engagement with said inclined second surface.

* * * * *